US007394015B2

(12) United States Patent
Takabayashi

(10) Patent No.: US 7,394,015 B2
(45) Date of Patent: Jul. 1, 2008

(54) PICKUP DEVICE FOR PLUCKED STRING INSTRUMENT AND PLUCKED STRING INSTRUMENT

(75) Inventor: Yojiro Takabayashi, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 218 days.

(21) Appl. No.: 11/132,914

(22) Filed: May 18, 2005

(65) Prior Publication Data

US 2005/0257670 A1 Nov. 24, 2005

(30) Foreign Application Priority Data

May 19, 2004 (JP) ..... 2004-149453

(51) Int. Cl.
*G10H 3/18* (2006.01)

(52) U.S. Cl. ..... 84/731; 84/291; 84/726; 84/730

(58) Field of Classification Search ..... 84/730, 84/731
See application file for complete search history.

(56) References Cited

U.S. PATENT DOCUMENTS

| | | | | |
|---|---|---|---|---|
| 2,222,057 | A * | 11/1940 | Benioff | 84/729 |
| 3,291,887 | A * | 12/1966 | Carman et al. | 84/731 |
| 3,325,580 | A * | 6/1967 | Barcus et al. | 84/731 |
| 3,453,920 | A * | 7/1969 | Scherer | 84/731 |
| 3,624,264 | A * | 11/1971 | Lazarus | 84/730 |
| 3,668,295 | A * | 6/1972 | Broussard | 84/726 |
| 3,733,425 | A * | 5/1973 | Chaki | 84/731 |
| 4,054,808 | A * | 10/1977 | Tanaka | 310/323.21 |
| 4,218,951 | A * | 8/1980 | Tressel | 84/294 |
| 4,860,625 | A * | 8/1989 | Mathews | 84/731 |
| 4,867,027 | A * | 9/1989 | Barbera | 84/731 |
| 4,916,350 | A * | 4/1990 | Madden et al. | 310/338 |
| 4,941,389 | A * | 7/1990 | Wendler | 84/727 |

(Continued)

FOREIGN PATENT DOCUMENTS

JP 7-152378 A 6/1995

(Continued)

OTHER PUBLICATIONS

Akustische Gitarre Richtig Verstaerkt, Funkschau, Weka-Fachzeitschr. Verlag, Poing, DE, No. 24, Nov. 1981, pp. 115-116, XP000763006, ISSN: 0016-2841.

*Primary Examiner*—Lincoln Donovan
*Assistant Examiner*—Christina Russell
(74) *Attorney, Agent, or Firm*—Morrison & Foerster LLP

(57) ABSTRACT

A pickup device (11) sandwiched between strings (3) and a top (4) of a body in a plucked string instrument comprises: a saddle (16) transmitting vibrations of the strings (3) to the body; and a bridge (25) fixedly attached on the top (4) of the body to support the saddle (16). Piezoelectric films (17, 18) being piezoelectric elements are pasted on areas of a front surface of the bridge (25) excluding a portion in which the saddle (16) is fitted. The vibrations of the strings (3) cause the pickup device (11) to also vibrate together with the top (4) of the body, and the portions of the bridge (25) on which the piezoelectric films (17, 18) are pasted make the largest bending deformations. The piezoelectric films (17, 18) are also free to make bending deformations to efficiently output electrical signals by a piezoelectric effect for musical sound in all pitch ranges.

10 Claims, 5 Drawing Sheets

U.S. PATENT DOCUMENTS

| | | | | | |
|---|---|---|---|---|---|
| 5,078,041 | A * | 1/1992 | Schmued | 84/731 |
| 5,123,325 | A * | 6/1992 | Turner | 84/731 |
| 5,204,487 | A * | 4/1993 | Turner | 84/731 |
| 5,218,159 | A * | 6/1993 | McClish | 84/731 |
| 5,438,157 | A * | 8/1995 | Lace et al. | 84/726 |
| 5,900,572 | A * | 5/1999 | Aaroe | 84/731 |
| 5,911,171 | A * | 6/1999 | Wońg | 84/731 |
| 5,945,622 | A * | 8/1999 | Yamada | 84/731 |
| 6,008,440 | A * | 12/1999 | Yamada | 84/291 |
| 6,018,120 | A * | 1/2000 | Steinberger | 84/731 |
| 6,075,198 | A * | 6/2000 | Grant et al. | 84/731 |
| 6,239,349 | B1 * | 5/2001 | Fishman | 84/731 |
| 6,255,565 | B1 * | 7/2001 | Tamura | 84/275 |
| 6,429,367 | B2 * | 8/2002 | Fishman | 84/730 |
| 6,515,214 | B2 * | 2/2003 | Takabayashi | 84/731 |
| 6,677,514 | B2 * | 1/2004 | Fishman | 84/730 |
| 6,791,023 | B2 * | 9/2004 | Nakaya | 84/736 |
| 6,822,156 | B1 * | 11/2004 | Lazarus et al. | 84/731 |
| 7,138,577 | B2 * | 11/2006 | Takabayashi | 84/731 |
| 2001/0024067 | A1 * | 9/2001 | Fishman | 310/1 |
| 2002/0092403 | A1 * | 7/2002 | McGuire et al. | 84/291 |
| 2002/0117047 | A1 * | 8/2002 | Fishman | 84/730 |
| 2002/0157523 | A1 * | 10/2002 | Takabayashi | 84/731 |
| 2004/0255762 | A1 * | 12/2004 | Takabayashi | 84/730 |
| 2005/0011342 | A1 * | 1/2005 | Fishman | 84/730 |

FOREIGN PATENT DOCUMENTS

| | | |
|---|---|---|
| WO | WO-00/42599 | 7/2000 |

* cited by examiner

PICKUP DEVICE FOR PLUCKED STRING INSTRUMENT AND PLUCKED STRING INSTRUMENT

BACKGROUND OF THE INVENTION

1. Field of the Invention

The invention relates to a pickup device for plucked string instrument capable of detecting, as electrical signals, vibrations of strings that occur when an acoustic plucked string instrument such as a guitar, a mandolin, a ukulele is played, and to a plucked string instrument including the same.

2. Description of the Related Art

Generally, a plucked string instrument such as a guitar, a mandolin, or a ukulele is structured such that both ends of a plurality of strings are fixed to an instrument main body constituted of a body and a neck, and a bridge is sandwiched by the strings therebetween and a top of the body in the instrument main body. A plucking operation of plucking the strings between the bridge and a nut on the neck side with fingers or nails produces musical sound. In this plucking operation, the strings are pressed against a fingerboard provided in the neck, and the pitch of the musical sound depends on the pressed position of the strings. The bridge, in a case of a guitar, is formed of a bridge fixedly attached on the top of the body and a saddle supportedly fitted in the bridge.

An electric plucked string instrument is one of such plucked string instruments. The electric plucked string instrument produces musical sound similar to that of an acoustic plucked string instrument in such a manner that a pickup device detects vibrations of strings plucked with fingers or nails to transduce the vibrations into electrical signals, and the electrical signals after being amplified are subjected to filtering or the like to become musical sound signals, which are then electroacoustically transduced by a speaker. According to this electric plucked string instrument, it is possible to play the instrument with a desired volume, to practice playing the instrument while listening to the musical sound through a headphone instead of the speaker, and to record signals of the musical sound produced by the played instrument to a recording medium such as a recording tape or a recording disk.

A conventionally available example of the aforesaid pickup device used for a guitar is a magnetic pickup device that electrically detects vibrations of strings, which are all steel strings, by an electromagnetic induction effect of a coil. However, recent years have seen a demand for faithful detection of raw sound peculiar to the instrument, also in an acoustic guitar, a ukulele, and the like using nonmetallic, nylon strings or the like.

As a pickup device used for this purpose, for example, U.S. Pat. No. 5,123,325B and JP H7-152378A disclose pickup devices using a piezoelectric transducer made of a polymer piezoelectric element or a piezoelectric film.

The pickup devices disclosed in these patent documents are both structured such that a piezoelectric transducer is sandwiched by a bridge and a saddle. The piezoelectric transducer receives vibrations of strings via the saddle to generate an electromotive force by a piezoelectric effect, so that the vibrations of the strings can be detected as electrical signals.

A structure of the conventional pickup device will be simply described with reference to FIG. 11.

FIG. 11 is a cross-sectional view of the bridge of the pickup device taken along a longitudinal direction. This pickup device 35 is structured such that, similarly to a typical guitar, a saddle 16 is supportedly fitted in a bridge 25 fixedly attached on a top 4 of a body to support a plurality of strings 3, and a piezoelectric transducer 36 is inserted in a part where the saddle 16 and the bridge 25 are fitted to each other. The piezoelectric transducer 36 is made of a polymer piezoelectric element or a piezoelectric film having electrodes on upper and lower surfaces thereof and has an elongated shape so as to extend along the whole length of a bottom of the saddle 16. The vibrations of the strings 3 caused by a plucking operation varies a pressing force that is applied to the piezoelectric transducer 36 via the saddle 16, and thus an electromotive force by a piezoelectric effect is generated, so that the piezoelectric transducer 36 outputs electrical signals according to the vibrations of the strings.

However, in the conventional pickup device 35 as structured above, the piezoelectric transducer 36 is constantly given a strong static pressure from the saddle 16 in a state in which the strings are stretched and tuned so as to be playable. The piezoelectric transducer receiving such a preliminary stress needs to be given a considerably strong force in order to generate a sufficient electromotive force. In addition, the piezoelectric transducer 36 generates a strong electromotive force when being displaced in its thickness direction. However, the vibrations of the strings 3 caused by the plucking operation in a guitar or the like is in a direction substantially parallel to the longitudinal direction of the piezoelectric transducer 36 as arranged above. Therefore, a vibration component in the thickness direction is relatively small.

Further, the aforesaid preliminary stress applied to the piezoelectric transducer 36 inhibits free movement of the piezoelectric transducer 36. Therefore, in such a conventional pickup device 35, only small outputs of the electrical signals are obtained from the piezoelectric transducer 36, and thus a preamplifier or the like with a high amplification factor has been indispensable.

Further, in the piezoelectric transducer 36 in the state of receiving the aforesaid preliminary stress, a frequency characteristic of the piezoelectric effect for the vibrations of the strings is inferior, resulting in nonuniform power generation output for frequency components of the vibrations of the strings producing musical sound. Consequently, musical sound produced based on the electrical signals detected by the pickup device 35 becomes far different in tone from the original raw sound of the instrument. Therefore, tone correction by an equalizer has been necessary.

SUMMARY OF THE INVENTION

The invention was made to solve these problems, and its object is to realize a large output for a detected signal by a pickup device for plucked string instrument and to improve its frequency characteristic. Another object is to realize, in a plucked string instrument including the pickup device, large output of an electrical signal and faithful reproduction of an original tone of the instrument.

In order to achieve the objects stated above, a pickup device for plucked string instrument according to the present invention includes: a saddle sandwiched between a string and a top of a body in a plucked string instrument and serving as a member transmitting a vibration of the string to the body; a bridge having the saddle fitted therein along a longitudinal direction to support the saddle and fixedly attached on the top of the body; and a piezoelectric element pasted on or buried in an area of a front surface of the bridge excluding a portion in which the saddle is fitted.

Preferably, the piezoelectric element is provided in at least one of two areas of the front surface between longitudinal both ends of the bridge and longitudinal both ends of the saddle.

In order to achieve the objects stated above, a plucked string instrument according to the invention includes the above-described pickup device for plucked string instrument provided between the string and a top of the body, with the aforesaid bridge being fixedly attached on the top.

Further, the pickup device attached to the plucked string instrument may include a plurality of piezoelectric elements that are pasted on or buried in areas of a front surface of the bridge excluding a portion in which the saddle is fitted, and a mixing circuit mixing respective output signals of the plural piezoelectric elements may be provided.

In the pickup device for plucked string instrument according to the invention, the piezoelectric element such as a piezoelectric film is pasted on or buried in the area of the front surface of the bridge excluding the portion in which the saddle is fitted, and thus is given no preliminary stress, which allows free deformation of the piezoelectric film.

Therefore, when receiving vibrations of the strings via the saddle, the piezoelectric element together with the bridge freely makes a bending deformation in a longitudinal direction and a width direction. Due to the bending deformation, one of an upper surface side and a lower surface side of the piezoelectric element expands and the other side contracts, resulting in uniform deformation, which makes it possible to output a large electrical signal with high power generation efficiency.

Moreover, owing to no preliminary stress given to the piezoelectric element, minute vibrations of the strings giving only a small force can be detected and the frequency characteristic is improved, which enables detection of any sound from low-pitch range to high-pitch renge with uniform sensitivity.

Since the plucked string instrument according to the invention includes the above-described pickup device for plucked string instrument, it is capable of outputting large electrical signals by the vibrations of the strings when the instrument is played, and faithfully reproducing an original tone of the instrument.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, preferred embodiments of the invention will be specifically described with reference to the drawings.

Embodiment of Pickup Device

Figure 1:
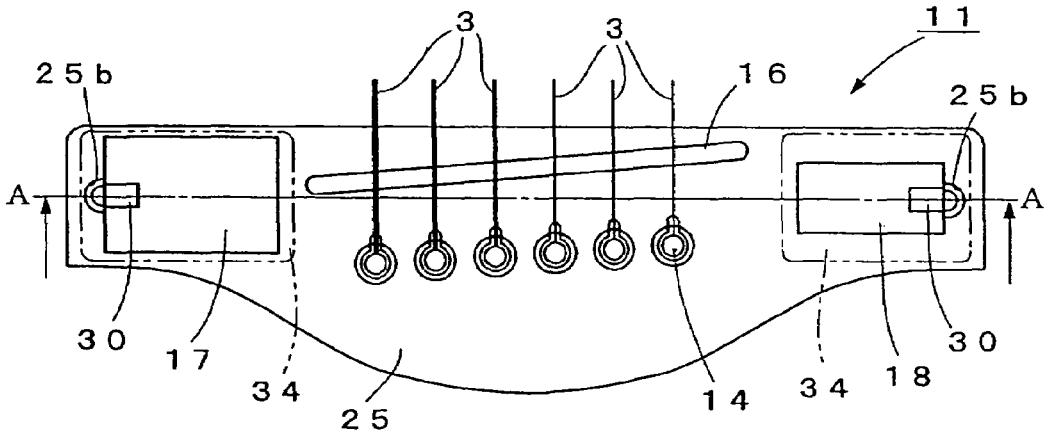
FIG. 1 is a front view of an embodiment of a pickup device according to the invention.
Figure 2:
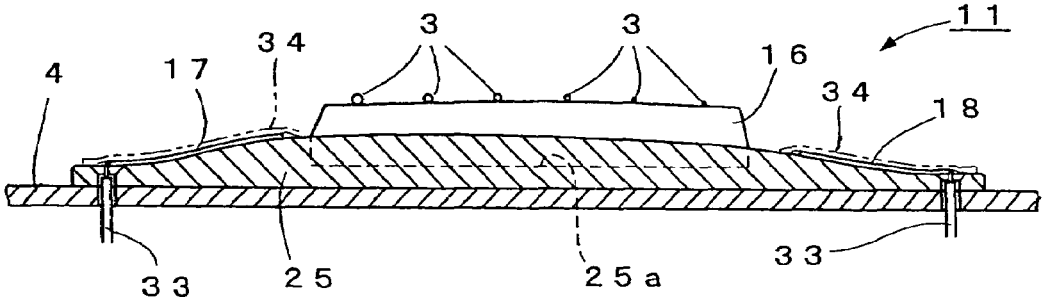
FIG. 2 is a cross-sectional view taken along the A-A line in FIG. 1.
Figure 3:
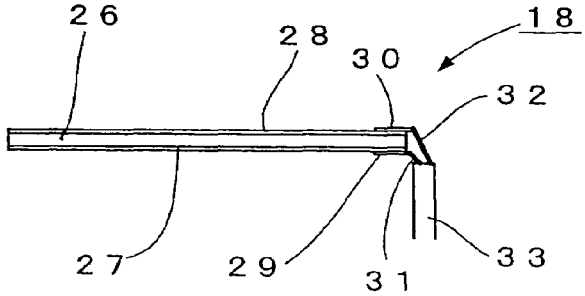
FIG. 3 is an enlarged side view showing a structure of a piezoelectric film in FIG. 2.

First, an embodiment of a pickup device for plucked string instrument according to the invention will be described with reference to FIG. 1 to FIG. 3. FIG. 1 is a front view of the pickup device and FIG. 2 is a cross-sectional view of the same taken along the A-A line. FIG. 3 is an enlarged side view showing a structure of a piezoelectric film being a piezoelectric element of the same, with a thickness direction enlarged at a large magnification ratio.

In FIG. 1, a pickup device 11 of this embodiment includes a wooden bridge 25 fixedly attached on a top 4 of a body of a later-described plucked string instrument, a saddle 16 supportedly fitted in the bridge 25, and two piezoelectric films 17, 18 as piezoelectric elements pasted on a front surface of the bridge 25. Note that the pickup device 11 has the same structure as the structure of a bridge and a saddle for a typical acoustic guitar except that the piezoelectric films 17, 18 are pasted.

The bridge 25 has six through holes formed at the back of the saddle 16, and one end portion of each of six strings 3 with a fixedly attached stopper ball can be inserted in each of the through holes. After the strings are inserted thereto, anchor pins 14 are inserted in the through holes so that the one-side ends of the strings 3 can be fixed.

As shown in FIG. 1, the bridge 25 in a plane view has a shape elongated in an arrangement direction of the strings 3, with its center portion slightly bulged backward. As shown in FIG. 2, the bridge 25 in a cross-sectional view along the longitudinal direction has thin both end portions and a center portion that gently bulges to constitute a thick portion, and the bridge 25 is fixedly attached on an upper face of the top 4 with its flat bottom face being pasted on the upper face of the top 4. The bridge 25 further has a saddle slot 25*a* that is formed in the thick portion to have the saddle 16 fitted therein and also has through holes 25*b* (see FIG. 1) that are provided near its longitudinal both ends to have signal lines inserted therethrough.

The saddle 16 is a slender, thin plate made of plastic or the like. The saddle 16 is supported by fitting in the saddle slot 25*a* of the bridge 25, being extending along the longitudinal direction of the bridge 25 but slightly slanted relative to the arrangement direction of the strings, and supports the strings 3 by an upper edge of its portion protruding from the bridge 25 to give a tensile force to the strings 3.

In FIG. 2 which shows a view seen from the anchor pin 14 side, the left side of the saddle 16 is a low note side and the right side is a high note side. The six strings 3 are, in a case of a guitar, an E string, an A string, a D string, a G string, a B string, and an E string from the left, the left-end E string being the thickest and the right-end E string being the thinnest.

Also in FIG. 2, piezoelectric films 17, 18 are pasted on areas of the front surface of the bridge 25 between the vicinity of both ends of the thick portion in which the saddle 16 is fitted and the vicinity of the longitudinal both ends of the whole bridge 25.

As shown in the enlarged view in FIG. 3, the piezoelectric film 18 is structured such that electrode surfaces 27, 28 made of conductive films are formed on both surfaces of a piezoelectric film main body 26 which is a film piezoelectric element. The electrode surfaces 27, 28 are connected to lead wires 31, 32 via lead sheets 29, 30 respectively, and the two lead wires 31, 32 are joined together into one signal line 33 while being kept insulated from each other. The signal line 33 is led to an interior of the body of the later-described plucked string instrument via through holes of the bridge 25 and the top 4 as shown in FIG. 2.

The other piezoelectric film 17 also has the same structure as the piezoelectric film 18 described above except that the facing direction and size thereof are different.

In FIG. 1 which is a front view of the pickup device 11, the two piezoelectric films 17, 18 are pasted on two areas of the front surface between the longitudinal both ends of the bridge 25 and the longitudinal both ends of the saddle 16 respectively. Each of the piezoelectric films 17, 18 is in a rectangular shape, and a longitudinal direction thereof is perpendicular to a direction in which the strings 3 stretch. The piezoelectric film 17 on the low note side is wider than the piezoelectric film 18 on the high note side.

Further, the appearance will become better if cover sheets 34 are pasted on the piezoelectric films 17, 18 as shown by the imaginary lines in FIG. 1 and FIG. 2 in order to cover all of the electrode surfaces 28, the lead sheets 30, the lead wires 31, 32, the signal lines 33, and so forth.

As will be described later, the piezoelectric films 17, 18 make bending deformations by the vibrations of the strings 3, and due to a piezoelectric effect thereof, electromotive voltages according to the vibrations of the strings are generated to be outputted as electrical signals to the signal lines 33 via the lead wires 31, 32. That is, when mechanical distortion acts on the piezoelectric films 17, 18, the piezoelectric effect causes an electrical polarization phenomenon in the thickness direction of the piezoelectric films 17, 18 in proportion to the magnitude of the distortion, so that a potential difference occurs between the electrode surfaces 27, 28 on the both surfaces of the piezoelectric films 17, 18, and the electrical signals are outputted to the two lead wires 31, 32 connected to the respective electrode surfaces 27, 28.

In the pickup device 11 of this embodiment, the piezoelectric films 17, 18 are pasted on the front surface of the bridge 25 and thus receive no preliminary force, which allows the piezoelectric films 17, 18 to be free to make bending deformations. Consequently, the pickup device 11 is capable of outputting larger electrical signals than those in a conventional pickup device, and outputting electrical signals faithful to waveforms of the vibrations of the strings owing to an improved frequency characteristic. These operations and effects will be described in detail later.

Incidentally, in this embodiment, the portion for fixing back ends of the strings 3 is provided integrally with the pickup device 11, but it may be separately provided. For example, as in a classical guitar, a tail piece for fixing the strings may be fixedly attached on the top of the body separately from the bridge, and the strings may be inserted in holes provided in the tail piece for binding.

Embodiment of Plucked String Instrument

Figure 4:
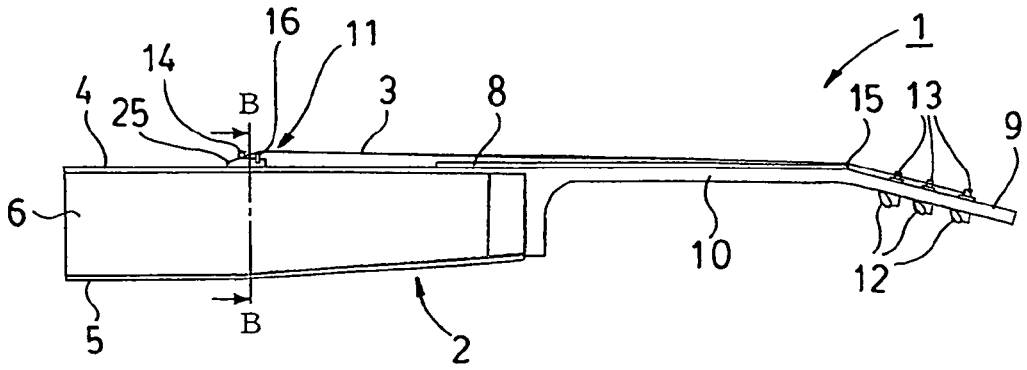
FIG. 4 is a side view of an embodiment of a plucked string instrument according to the invention.

Next, an embodiment of a plucked string instrument according to the invention will be described with reference to FIG. 4 and FIG. 5. FIG. 4 is a side view of the plucked string instrument and FIG. 5 is a front view showing the plucked string instrument together with a detection signal output circuit and a sound system constituted of an amplifier and a speaker.

The plucked string instrument 1 of this embodiment has substantially the same structure as that of an acoustic guitar. A body 2 being an instrument main body has a top 4 and a back 5 both of which have the same outer peripheral shape, and is a hollow-structured resonance body with the outer peripheries of the top 4 and the back 5 being bonded together with a side 6 having a curved surface. In a center portion of a smaller bulged portion of the top 4, a circular sound hole 7 is formed.

Figure 5:
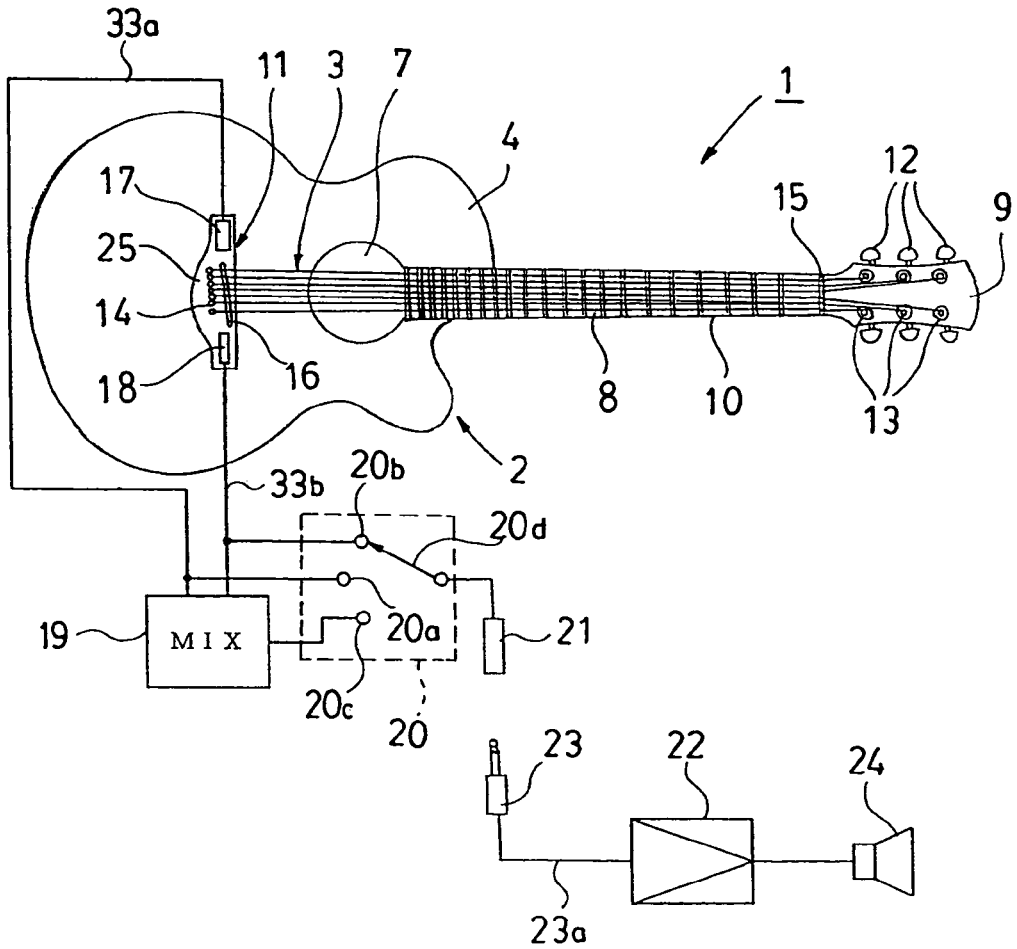
FIG. 5 is a front view showing the plucked string instrument shown in FIG. 4 together with a detection signal output circuit and a sound system constituted of an amplifier and a speaker.

A neck 10 supporting a fingerboard 8 and having a head 9 at its end portion is fixed to an end portion of the body 2 on the right side in FIG. 4 and FIG. 5. The above-described pickup device 11 according to the invention is fixedly attached by gluing on a front surface of the top 4 on an opposite side of the fingerboard 8 (the left side in FIG. 4).

The head 9 at the end portion of the neck 10 is provided with six tuning keys 13 interlocked to pegs 12 respectively to rotate, and the six strings 3 made of steel, gut, or the like are suspended between the tuning keys 13 and the anchor pins 14 inserted in the six through holes formed in the bridge 25 of the pickup device 11. A nut 15, which is provided on the boundary of the head 9 and the neck 10, and the saddle 16, which is supportedly fitted in the bridge 25 of the pickup device 11, support the strings 3 and give tensile forces to the strings 3.

In this embodiment, as shown in FIG. 5, in the pickup device 11, the two piezoelectric films 17, 18 as piezoelectric elements for detecting the vibrations of the strings 3 as electrical signals are pasted on the front surface of the bridge 25. A detected signal by the low note side piezoelectric film 17 is outputted to a signal line 33*a* and a detected signal by the high note side piezoelectric film 18 is outputted to a signal line 33*b*.

Further, a mixer (MIX) 19 being a mixing circuit is provided inside the body 2 and a select switch 20 being a selector is provided at a position operable from an external part. The signal lines 33*a*, 33*b* from the two piezoelectric films 17, 18 are connected to input pins of the mixer 19, and are also connected to fixed contacts 20*a*, 20*b* of the select switch 20 respectively. Further, an output pin of the mixer 19 is connected to a fixed contact 20*c* of the select switch 20, and a movable contact 20*d* of the select switch 20 is connected to a jack 21.

Therefore, by a switching operation of the select switch 20, one of the electrical signals outputted from the two piezoelectric films 17, 18 respectively or a mixed signal thereof generated by the mixer 19 can be selected to be outputted.

The reference numerals 22 in FIG. 5 denotes an amplifier prepared outside separately from the plucked string instrument 1, and this amplifier 22 amplifies an input signal from a signal line 23*a* connected to a plug 23 insertable to the jack 21, to output the amplified signal to a speaker 24, where the signal is electroacoustically transduced and outputted as musical sound. A headphone, a recorder, or the like may be connected in place of this speaker 24.

Here, when a player plays the plucked string instrument 1 with the plug 23 inserted to the jack 21 of the plucked string instrument 1, the player's plucking operation causes the vibrations of the strings 3, which are then detected and outputted as electrical signals by the two piezoelectric films 17, 18 of the pickup device 11, and the electrical signal after being amplified by the amplifier 22 is electroacoustically transduced by the speaker 24 or a not-shown headphone, so that the sound of the played plucked string instrument 1 can be outputted.

In this embodiment, the piezoelectric film 17 in FIG. 5 mainly detects vibration components of the low note side strings, among the six strings 3, positioned close to the piezoelectric film 17, the vibration component of the string closer thereto being detected in larger volume. The piezoelectric film 18 mainly detects vibration components of the high note side strings positioned close thereto, the vibration component of the string closer thereto being detected in larger volume. Therefore, the piezoelectric film 17 outputs a signal in which low-pitch range sound is stressed while the piezoelectric film 18 outputs a signal in which high-pitch range sound is stressed.

Here, when the output signal of the piezoelectric film 17 is selected, it is possible to output a signal suitable for performance in which, for example, a lead phrase is played with a rich, deep sound. On the other hand, when the output signal of the piezoelectric film 18 is selected, it is possible to output a signal suitable for articulate performance such as, for example, chord accompaniment in which rhythm plays a major role. Further, when the output signal of the mixer 19 is selected, it is possible to output a signal in which sound in all the pitch ranges is well balanced.

Incidentally, only the mixed signal of the mixer 19 may be outputted without providing the aforesaid select switch 20. Moreover, a mixing ratio thereof may be fixed or may be variable by an external operation.

Further, the number of the piezoelectric films is not limited to two, but one piezoelectric film or a plurality of piezoelectric films may be provided at position(s) where signals in a required pitch range can be extracted.

Operations and Effects of the Embodiment

In the pickup device 11 according to the invention, the piezoelectric films 17, 18 are pasted on the areas of the front surface of the bridge 25 excluding the portion in which the saddle 16 is fitted. Therefore, the plucked string instrument with this pickup device 11 attached thereto as described above is capable of outputting a larger electrical signal than a plucked string instrument with a conventional pickup device attached thereto. The reasons for this will be discussed below.

Figure 6:
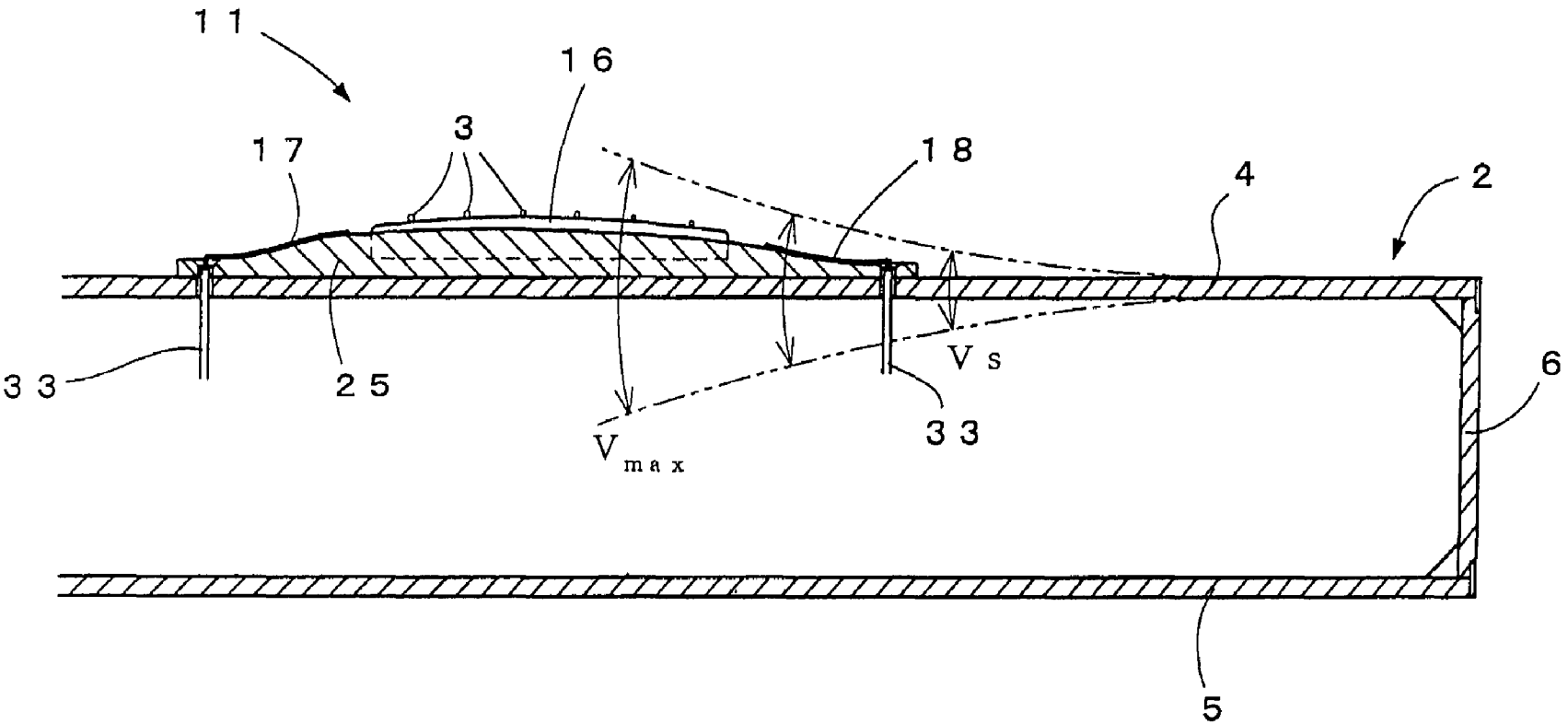
FIG. 6 is an enlarged partial cross-sectional view taken along the B-B line in FIG. 4.

FIG. 6 is an enlarged partial cross-sectional view taken along the B-B line in FIG. 4, and shows how the top 4 of the body 2 and the pickup device 11 vibrate in accordance with the vibrations of the strings 3. In this drawing, the same reference numerals are used to designate portions corresponding to those in FIG. 1 to FIG. 5. Though FIG. 6 does not show the left portion of the body 2, the top 4 and the back 5 are equal in width, and the left end portions thereof are also bonded together via the side 6.

When back ends of the six strings 3 are stretched on the top 4 and the strings 3 are tuned, the top 4 and the bridge 25 and saddle 16 of the pickup device 11 fixedly attached on the front surface of the top 4 are given pressing forces in a thickness direction thereof (an up/down direction of the drawing) by tensile forces of the strings 3, but the pressing forces and a resilient restoring force of the top 4 are balanced, producing a stable state.

When the strings 3 are plucked from this state, the vibrations of the strings 3 propagate to the top 4 via the saddle 16 and the bridge 25, so that the pressing forces by the tensile forces of the strings 3 and the resilient restoring force of the top 4 get out of balance to vibrate the top 4. Then, this vibrational displacement of the top 4 in the thickness direction generates a compressional wave of air, so that musical sound by the strings' vibrations is outputted in large volume.

At this time, the top 4 vibrates in the thickness direction, but since its outer periphery is fixed to the side 6, an amplitude Vs of the vibration is smaller at a position closer to the outer periphery as exaggeratedly shown by the chain double-dashed line in FIG. 6, and the vicinity of its center position in the width direction of the body 2 vibrates with the maximum amplitude Vmax. Consequently, the bridge 25 fixedly attached on the front surface of the widthwise center portion of the top 4 makes a bending deformation by the vibration of the top 4.

Figure 7:
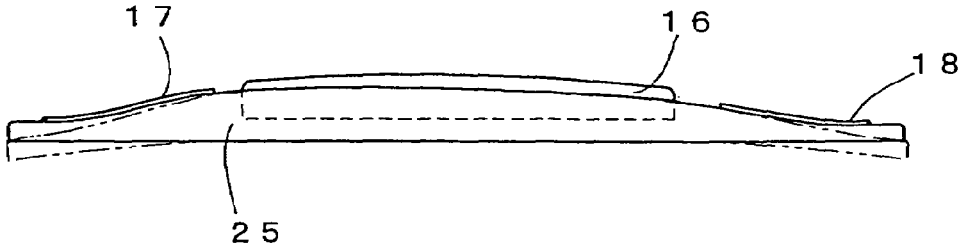
FIG. 7 is an explanatory view of a bending deformation of a bridge when a center portion of a top bulges most outward.
Figure 8:
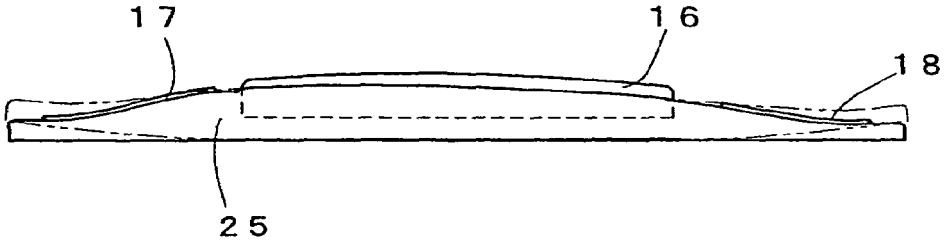
FIG. 8 is an explanatory view showing a bending deformation of the bridge when the center portion of the top curves most inward.

FIG. 7 and FIG. 8 are views showing how the bridge 25 makes the bending deformation, in both of which the bridge 25 without the bending deformation is shown by the solid line. The bridge 25 with the bending deformation when the top 4 is displaced with its center portion bulging most outward is shown by the imaginary line in FIG. 7, and the bridge 25 with the bending deformation when the top 4 is displaced with its center portion curved most inward is shown by the imaginary line in FIG. 8.

Thus, a large bending deformation repeatedly occurs in relatively thin areas near the longitudinal both end portions of the bridge 25 (areas excluding the thick area in which the saddle 16 is supportedly fitted).

Since the piezoelectric films 17, 18 are pasted on the areas of the front surface of the bridge 25 where this large bending deformation occurs, the piezoelectric films 17, 18 also repeatedly make bending deformations mainly in the longitudinal direction.

Generally, a piezoelectric effect by a piezoelectric element such as a flexible piezoelectric film capable of making a bending deformation can produce an output signal with a remarkably higher power generation when the piezoelectric element makes a bending deformation with one of the upper and lower surfaces thereof being expanded and the other being contracted, compared with a case where a strong pressure is locally applied to the piezoelectric element. This is because the bending deformation of the piezoelectric element results in distortion in the thickness direction that is uniform over the entire deformed portion in the bending direction, which enables even a small force to produce a large distortion amount as the whole piezoelectric element, resulting in a high piezoelectric effect.

Figure 11:
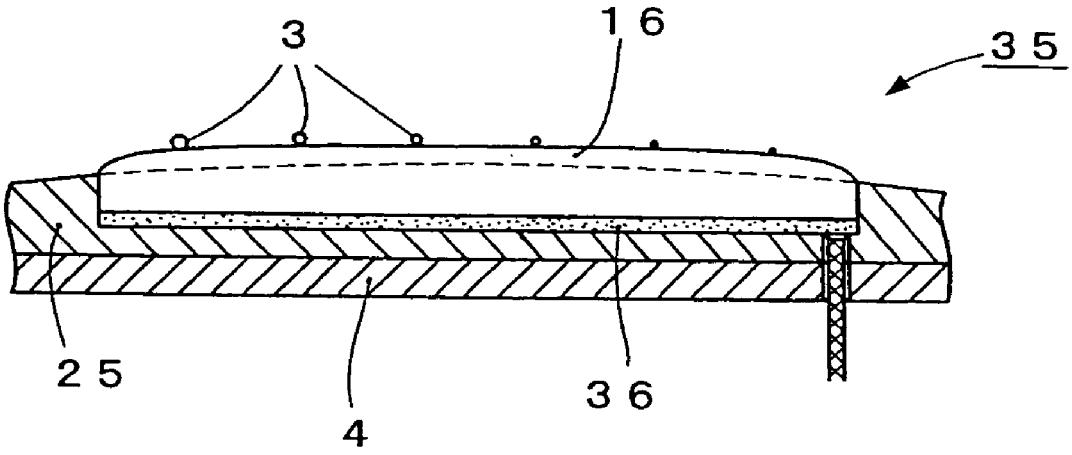
FIG. 11 PRIOR ART
FIG. 11 is a cross-sectional view of a portion where a piezoelectric transducer is provided in a conventional pickup device, taken along an arrangement direction of strings.

Since the piezoelectric element has such a property, in the structure of the conventional pickup device described in FIG. 11, even if a piezoelectric element such as a piezoelectric film is used as the piezoelectric transducer 36 thereof, only part in the longitudinal direction thereof is given a pressing force by the vibrations of the strings 3, so that the distortion as a whole is small and thus a detected electrical signal is also small.

As compared with the conventional pickup device, the pickup device 11 of this embodiment is capable of outputting a larger electrical signal with a high power generation efficiency since the vibrations of the strings 3 can cause a large bending deformation (especially in the longitudinal direction) of the entire two piezoelectric films 17, 18.

In particular, in the pickup device 11 of this embodiment, the areas where the piezoelectric films 17, 18 are disposed are the relatively thin areas of the bridge 25 on the right and left sides of the thick area in which the saddle 16 is supportedly fitted, and the piezoelectric films 17, 18 in a rectangular shape are set with the longitudinal direction thereof being perpendicular to the stretching direction of the strings. This structure makes it possible to efficiently transduce the vibrations of the strings 3 to the bending deformations in the longitudinal direction of the piezoelectric films 17, 18.

In addition, since the piezoelectric films 17, 18 are only pasted on the front surface of the bridge 25, a preliminary pressure is not applied thereto even when the stretched strings 3 are tuned. Therefore, it is possible to detect even a minute vibration that causes only a small bending deformation of the piezoelectric films 17, 18 and to obtain a uniform piezoelectric property for frequency components of the strings' vibrations, resulting in an improved frequency characteristic, so that signals for sound from a low-pitch range to a high-pitch range can be outputted with high sensitivity.

Further, since no preliminary pressure is applied to the piezoelectric films 17, 18, the piezoelectric films 17, 18 make substantially linear bending deformations relative to the bending deformation of the bridge 25, resulting in linear transducing of the strings' vibrations into the electrical signals.

As described above, the pickup device of this embodiment is capable of outputting a large electrical signal for the strings' vibrations, is superior in frequency characteristic for the entire pitch range of sound produced by the played instrument, and is good in linearity of signals. Therefore, the plucked string instrument provided with this pickup device is capable of transducing sound of the played instrument into a sufficiently large electrical signal for reproduction even without using a preamprefier, and is capable of faithfully reproducing the original tone of the instrument without using an equalizer.

Modification Example of the Invention

In the pickup device according to the invention, the positions where the piezoelectric elements such as the piezoelectric films are pasted are not limited to the areas near the longitudinal both end portions of the bridge 25, but they may be pasted on any positions as long as the positions are on the front surface of the area excluding the area in which the saddle 16 is supportedly fitted and the bending deformation can be caused by the strings' vibrations in these positions.

Figure 9:
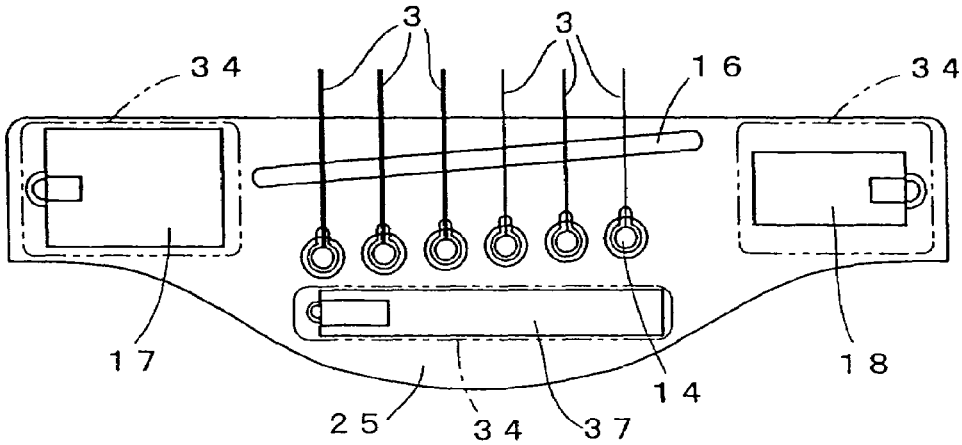
FIG. 9 is a front view showing another embodiment of the pickup device.

FIG. 9 shows such a modification example. In this example, besides the piezoelectric films 17, 18 pasted on the front surface near the longitudinal both end portions of the bridge 25, a piezoelectric film 37 in a rectangular shape elongated in the arrangement direction of the strings 3 is also pasted on the front surface of an area on a back side of the position where the back ends of the strings 3 are fixed by the insertion of the anchor pins 14.

Thus pasting the piezoelectric elements such as flexible piezoelectric films at various positions makes it possible to obtain signals different in frequency characteristic and time characteristic. Further, varying the size such as width and length among the plural piezoelectric films 17, 18, 37 as in the drawing makes it possible to produce difference in power generation amount and characteristic. Further, when these piezoelectric films different in arrangement and size are provided in large number and the selection of their output signals and the combination for mixing the output signals are variably set, it is possible to increase variations in tone, volume, and the like.

However, providing the plural piezoelectric films is not indispensable, but only one piezoelectric film may be pasted on the front surface of an area where the bending deformation of the bridge is easily caused.

Figure 10:
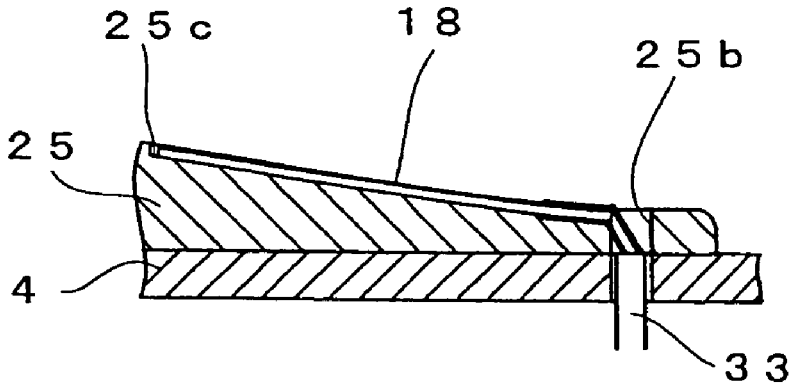
FIG. 10 is an enlarged partial cross-sectional view showing another example of a portion where a piezoelectric film is attached in the pickup device.

FIG. 10 shows another modification example. In this example, shallow recessed portion 25*c* is formed in front surface of area near longitudinal end portion of the bridge 25 where the bending deformation is easily caused, and the piezoelectric film 18 is pasted so as to be buried in the recessed portion 25*c*. This structure makes the front surface of the bridge 25 and an upper surface of the piezoelectric film 18 on the same level, resulting in better appearance of the pickup device.

Another possible structure may be to fill flexible resin or the like in a gap between the recessed portion 25*c* and the piezoelectric film 18 and form a coating film on the upper surface of the piezoelectric film 18 or to paste a cover sheet to cover an upper side of the recessed portion 25*c*. Such structures can hide the piezoelectric film 18 from sight, resulting in still better appearance. In this case, the area and depth of the recessed portion 25*c* preferably has margins so that the piezoelectric film 18 is free to make the bending deformation.

The foregoing embodiments have described the examples where the invention is applied to an acoustic guitar, but the invention is similarly applicable to other acoustic plucked string instruments such as a ukulele and a mandolin. In this case, materials, sizes, shapes, and so on of the saddle and the bridge constituting the pickup device are appropriately varied depending on the plucked string instruments. Further, the pickup device according to the invention can be structured such that a piezoelectric film is newly pasted on a front surface of an existing bridge provided in a plucked string instrument.

The invention is further applicable to an electric plucked string instrument and an electronic plucked string instrument of a silent type not having a resonance body of the instrument main body and producing musical sound only electrically or by electronic sound.

In the case of the electronic plucked string instrument, the pickup device according to the invention detects the vibrations of strings to transduce the vibrations into electrical signals, and data on the pitch and amplitude of musical sound is created from the signals to be imputed to an electronic tone generator, so that PCM-coded musical sound data stored in, for example, a ROM is read and D/A converted to generate musical tone signals. The musical tone signals are amplified by an amplifier, and then musical sound similar to that of an acoustic plucked string instrument such as a guitar can be outputted by a speaker or listened to through a headphone.

This invention is usable in various kinds of industries, for example, the industry manufacturing or remodeling acoustic plucked string instruments such as acoustic guitars, mandolins, and ukuleles and various kinds of silent-type electric plucked string instruments and electronic plucked string instruments for practice purpose of the above instruments, and the industry configuring music performance systems using these plucked string instruments. Further, the intended use of the invention is not limited to practice of plucked string instruments, but since expressive play for performance can be realized, performance in various forms is possible. Therefore, the plucked string instrument of the invention can be easily used for ensemble with other musical instruments producing a large volume such as an electric musical instrument or an electronic musical instrument. Therefore, elaborated performance with subtle expression of the intention of a player is realized.

What is claimed is:

1. A pickup device for plucked string instrument comprising:

a saddle sandwiched between a string and a top of a body in a plucked string instrument and serving as a member transmitting a vibration of the string to the body;

a bridge having said saddle fitted therein along a longitudinal direction to support said saddle and fixedly attached on the top of the body; and a piezoelectric element pasted on or buried in an area of a front surface of said bridge excluding a portion in which said saddle is fitted and receiving no preliminary force.

2. A pickup device for plucked string instrument according to claim 1, wherein said piezoelectric element is provided in at least one of two areas of the front surface between longitudinal both ends of said bridge and longitudinal both ends of said saddle.

3. A pickup device for plucked string instrument according to claim 2, wherein said piezoelectric element is provided in both of the two areas of the front surface.

4. A pickup device for plucked string instrument according to claim 1, wherein said piezoelectric element is provided in plurality.

5. A pickup device for plucked string instrument according to claim 4, wherein said plural piezoelectric elements are different in size.

6. A plucked string instrument comprising: a string; a body; and a pickup device provided between said string and said body, wherein said pickup device comprises:

a saddle sandwiched between the string and a top of the body in the plucked string instrument and serving as a member transmitting a vibration of the string to the body;

a bridge having the saddle fitted therein along a longitudinal direction to support the saddle and fixedly attached on the top of the body; and a piezoelectric element pasted on or buried in an area of a front surface of the bridge excluding a portion in which the saddle is fitted and receiving no preliminary force.

7. A plucked string instrument according to claim 6, wherein the piezoelectric element of said pickup device is provided in at least one of two areas of the front surface between longitudinal both ends of the bridge and longitudinal both ends of the saddle.

8. A plucked string instrument according to claim 7, wherein the piezoelectric element of said pickup device is provided in both of the two areas of the front surface, and the plucked string instrument further comprising a mixing circuit mixing respective output signals of the two piezoelectric elements.

9. A plucked string instrument according to claim 6, wherein the piezoelectric element of said pickup device is provided in plurality, and said plucked string instrument further comprising a mixing circuit mixing respective output signals of the plural piezoelectric elements.

10. A plucked string instrument according to claim 9, wherein the plural piezoelectric elements are different in size.

* * * * *